US011885529B2

(12) United States Patent
Kaneko et al.

(10) Patent No.: US 11,885,529 B2
(45) Date of Patent: Jan. 30, 2024

(54) PASS BOX

(71) Applicant: Hitachi Industrial Equipment Systems Co., Ltd., Tokyo (JP)

(72) Inventors: Takeshi Kaneko, Tainai (JP); Takeshi Matsumura, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 645 days.

(21) Appl. No.: 17/101,160

(22) Filed: Nov. 23, 2020

(65) Prior Publication Data

US 2021/0389003 A1 Dec. 16, 2021

(30) Foreign Application Priority Data

Jun. 10, 2020 (JP) ..... 2020-100881

(51) Int. Cl.

| | |
|---|---|
| ***F24F 8/90*** | (2021.01) |
| ***F24F 9/00*** | (2006.01) |
| ***F24F 8/95*** | (2021.01) |
| ***F24F 3/167*** | (2021.01) |

(52) U.S. Cl.

CPC ..... *F24F 8/90* (2021.01); *F24F 3/167* (2021.01); *F24F 8/95* (2021.01); *F24F 9/00* (2013.01); *F24F 2009/005* (2013.01)

(58) Field of Classification Search

CPC ..... F24F 8/90; F24F 8/95; F24F 3/167; F24F 9/00; F24F 2009/005

See application file for complete search history.

(56) References Cited

U.S. PATENT DOCUMENTS

| | | | | |
|---|---|---|---|---|
| 11,136,814 | B1 * | 10/2021 | Diccianni | E05G 7/005 |
| 2018/0311389 | A1 * | 11/2018 | Watanabe | C12M 37/00 |
| 2021/0389003 | A1 * | 12/2021 | Kaneko | F24F 8/108 |
| 2022/0184261 | A1 * | 6/2022 | Kaneko | A61L 9/20 |

FOREIGN PATENT DOCUMENTS

| | | | |
|---|---|---|---|
| CN | 103083696 | A | 5/2013 |
| CN | 204511106 | U | 7/2015 |
| CN | 104989245 | A * | 10/2015 |
| JP | 52-61946 | A | 5/1977 |
| JP | 2002-291850 | A | 10/2002 |
| JP | 4722642 | B2 | 7/2011 |
| JP | 2018-175172 | A | 11/2018 |

OTHER PUBLICATIONS

Japanese-language Office Action issued in Japanese Application No. 2020-100881 dated Jan. 10, 2023 with English translation (six (6) pages).

Chinese-language Office Action issued in Chinese Application No. 202011284384.6 dated Oct. 18, 2022 with English translation (12 pages).

* cited by examiner

*Primary Examiner* — Matthew W Ing

(74) *Attorney, Agent, or Firm* — Crowell & Moring LLP

(57) ABSTRACT

A pass box delivering an article with respect to a clean room includes a blower provided in an upper portion of the pass box, a first door on the clean room side, a first handle provided on the clean room side and opening and closing the first door, a first handle receiving portion rotating with the first handle in the pass box, a first handle receiving seat engaging with the first handle receiving portion in the pass box, and a storage stand provided in a lower portion of the pass box. The storage stand has a slit allowing air from the blower to be exhausted from an inner portion of the pass box.

4 Claims, 7 Drawing Sheets

PASS BOX

BACKGROUND OF THE INVENTION

1. Field of the Invention

The present invention relates to a pass box for taking a small article, sample, or the like in and out in the field of regenerative medicine where cells are cultured.

2. Description of the Related Art

A person or a large article is taken in and out after removal of adhering dust or bacteria by means of an air shower so that the cleanliness of a clean room is maintained and dust or bacterial infiltration from the outside is prevented. A small article, sample, or the like is taken in and out with respect to a clean room by means of a pass box. The pass box is used in the field of, for example, regenerative medicine where cells are cultured and industrial fields such as medical and pharmaceutical where pathogen handling and genetic manipulation are performed and is installed in a penetrating manner between two or more rooms different in cleanliness from each other so that the cleanliness of the clean room is maintained.

Dirt or adhering dust is removed, by cleaning by means of alcohol or the like, before an article is put into the pass box. In addition, a germicidal lamp may be used so that the surface of what is handled is sterilized with the article put in by a pass box door being opened and the door being closed again.

JP 4722642 B2 illustrates an example of a pass box using a germicidal lamp.

In the field of regenerative medicine where cells are cultured, different articles such as equipment used for cell culture are delivered by means of a pass box, especially in the case of handling a specimen such as a cell vulnerable to contamination, for the purpose of mutual contamination prevention. The risk of contamination is suppressed by the cleanliness in the pass box being ensured.

Although JP 4722642 B2 describes surface sterilization means based on ultraviolet irradiation by means of a germicidal lamp, JP 4722642 B2 does not consider the dust that is generated when the pass box is used. In other words, JP 4722642 B2 does not consider the prevention of intra-pass box contamination attributable to dust generation caused by pass box door handle operation and dust leakage into a clean room.

SUMMARY OF THE INVENTION

An object of the present invention is to not only perform surface sterilization by means of a germicidal lamp but also prevent contamination of a clean room on a clean area side inside or outside a pass box attributable to dust generation caused by pass box handle operation during article delivery by means of the pass box.

In order to achieve the above object, an example of the pass box of the present invention includes a blower provided in an upper portion of the pass box, a first door on a clean room side, a first handle provided on the clean room side and opening and closing the first door, a first handle receiving portion rotating with the first handle in the pass box, a first handle receiving seat engaging with the first handle receiving portion in the pass box, and a storage stand provided in a lower portion of the pass box. The storage stand has a slit allowing air from the blower to be exhausted from an inner portion of the pass box.

According to the present invention, it is possible to provide a pass box that is capable of preventing contamination attributable to dust resulting from rubbing between a door handle and a handle receiver fixing the door handle when a door of the pass box is opened and closed in a case where an article is delivered in the pass box and does not contaminate dust generation to a clean room on a clean area side outside the pass box.

Objects, configurations, and effects other than those described above will be clarified by the following description of an embodiment.

DETAILED DESCRIPTION OF THE PREFERRED EMBODIMENTS

Figure 1A:
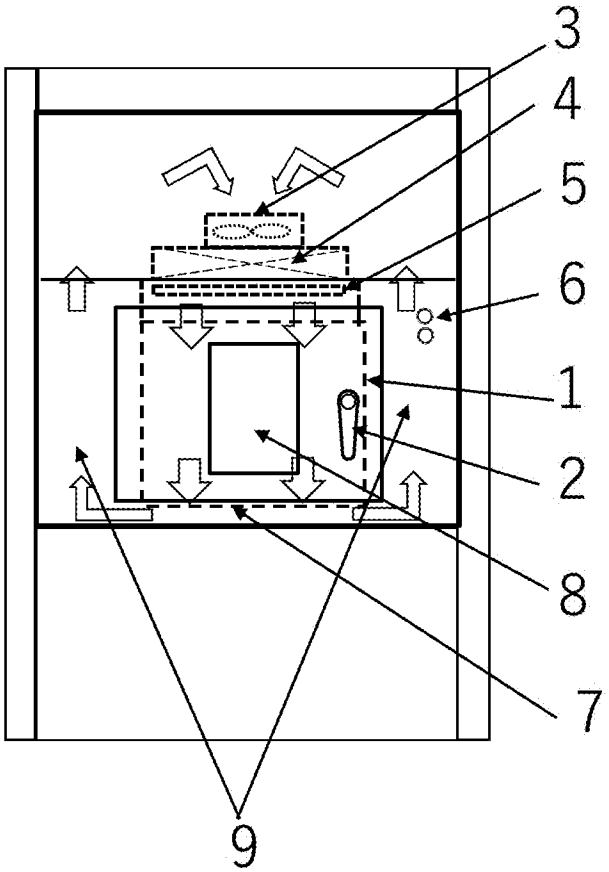
FIG. 1A is a front view illustrating an example of a pass box of Example 1.

An embodiment of the present invention will be described with reference to the drawings. It should be noted that the same constituent elements in the drawings for describing the embodiment are given the same name and reference numeral as much as possible and repeated description thereof will be omitted.

The pass box according to the present embodiment has a blower for air circulation and a HEPA filter for air purification in order to maintain the cleanliness in the pass box. In addition, a component that receives a handle fixing a pass box door is disposed in the pass box room inside the door and the pass box is characterized by being provided with a mechanism preventing dust generated as a result of contact between the handle and a handle receiving portion from being scattered toward a clean room. Here, HEPA filter stands for high efficiency particulate air filter.

Example 1

Figure 1B:
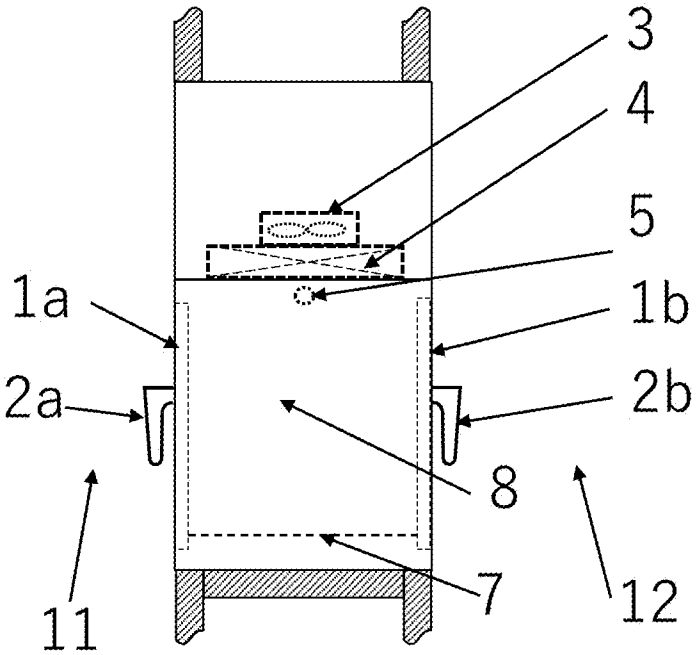
FIG. 1B is a right side view illustrating an example of the pass box of Example 1.

FIG. 1A is a front view illustrating an example of the pass box of Example 1, and FIG. 1B is a right side view.

A pass box 10 has doors 1 in the front and rear in order to deliver an article with respect to the clean room, and the doors are opened and closed by a handle 2. A blower 3, a high efficiency particulate air filter (HEPA filter) 4, and a germicidal lamp 5 are in the upper portion of the pass box. In addition, an indicator lamp 6 displays the states of, for example, electric power supply, fan operation, and opening of the door 1. The arrows in FIG. 1A indicate the airflow circulation path in the pass box 10. Air is pushed in by the blower 3, passes through the HEPA filter 4, becomes clean air, passes through a delivery space 8, passes through the slit or hole portion open on a storage stand 7 in the lower portion of the pass box, and returns to the blower 3 in the upper portion of the circulation path. In this manner, the air circulates in the same path in the pass box and continues to supply clean air to the delivery space 8.

Figure 2:
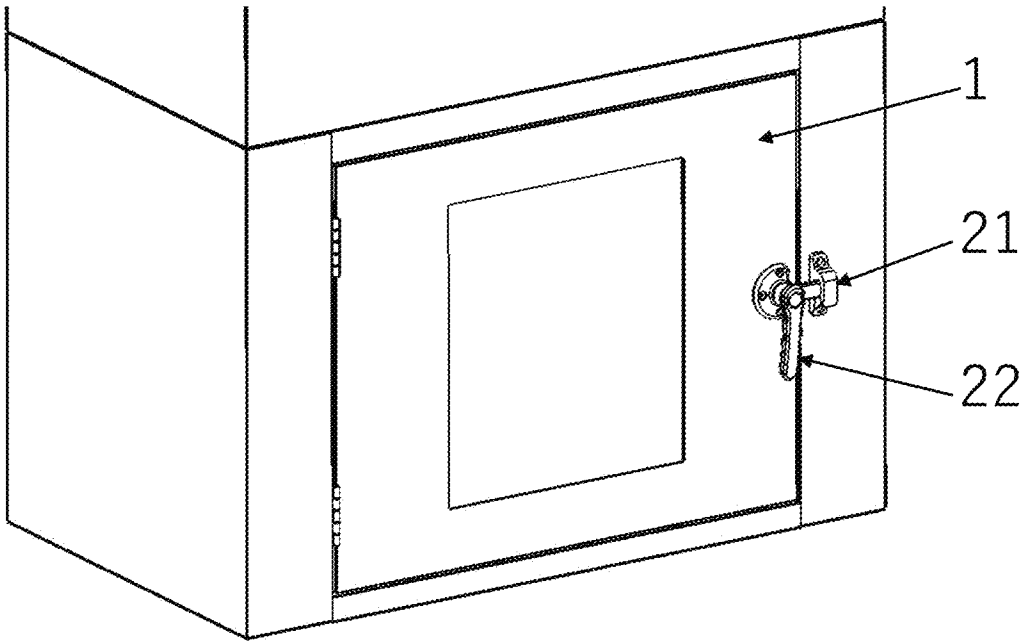
FIG. 2 is a diagram illustrating an existing pass box.

As illustrated in FIG. 1B, during article delivery, a door 1*a* on a contaminated area 11 side on the side that is opposite to the clean room is opened, the article is put into the delivery space 8, and then the door 1*a* is closed again. As a result of the opening and closing of the door 1*a* at this time, the air in the contaminated area 11 may enter the delivery space 8 to cause a decline in cleanliness. In addition, the cleanliness of a clean area 12 is maintained by a door 1*b* on the clean room side of the clean area 12 being provided with a timer and an interlocking mechanism being provided such that opening for a certain period of time is impossible, which is to restore the cleanliness of the delivery space 8 in view of dust generation from the delivered article itself. The other factors causing the decline in cleanliness include dust generation during the operation of handles 2*a* and 2*b* during the opening and closing of the doors 1*a* and 1*b*. FIG. 2 illustrates an example of existing pass boxes in order to describe this problem.

FIG. 2 illustrates the existing pass box. An existing handle 22 is on the outside of the door 1, and a handle receiving seat 21 is outside the pass box in order to lock the existing handle 22. When the door 1 is locked, the handle 22 and the handle receiving seat 21 come into contact with each other and become a dust generation source. The force of the contact and the amount of generated dust increase along with the degree of sealing at which the door is kept. It should be noted that a stainless material is often used for the handle 22 and the handle receiving seat 21 in view of durability and chemical resistance. On the clean room side of the clean area, the inter-metal contact results in metal contamination, which is not preferable. However, these materials are not limited to the stainless material. An example as a solution to this problem is illustrated in FIGS. 3 and 4.

Figure 3:
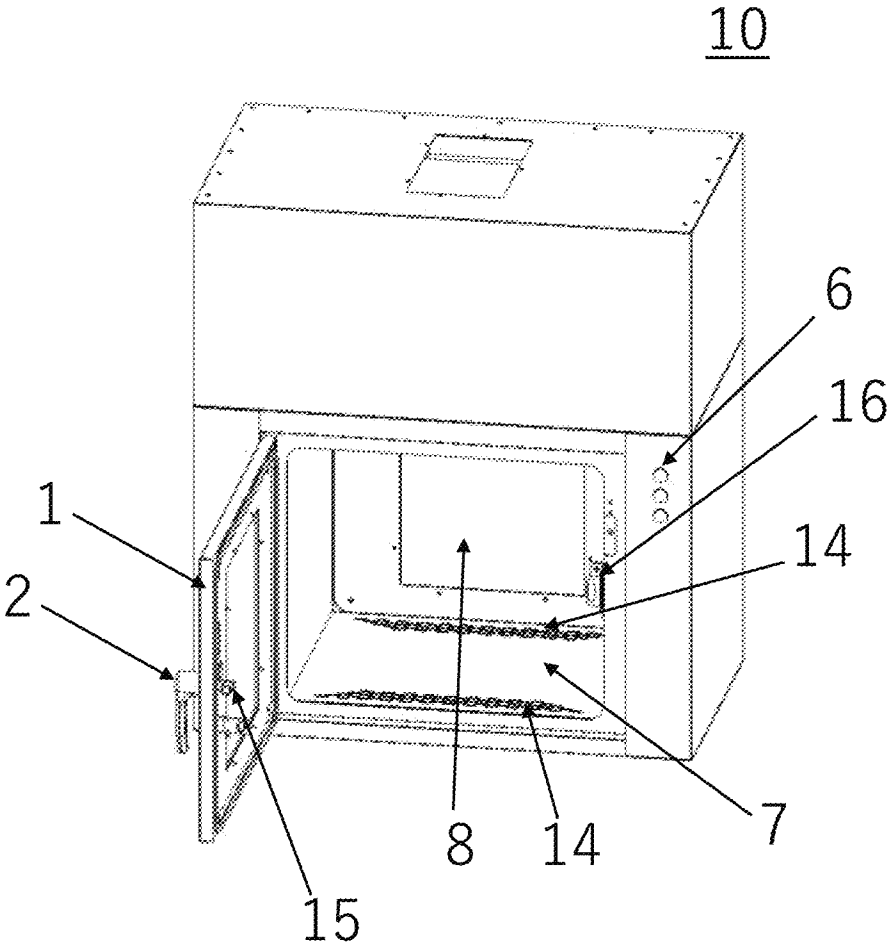
FIG. 3 is a diagram illustrating a state where one door of the pass box of Example 1 is open.
Figure 4:
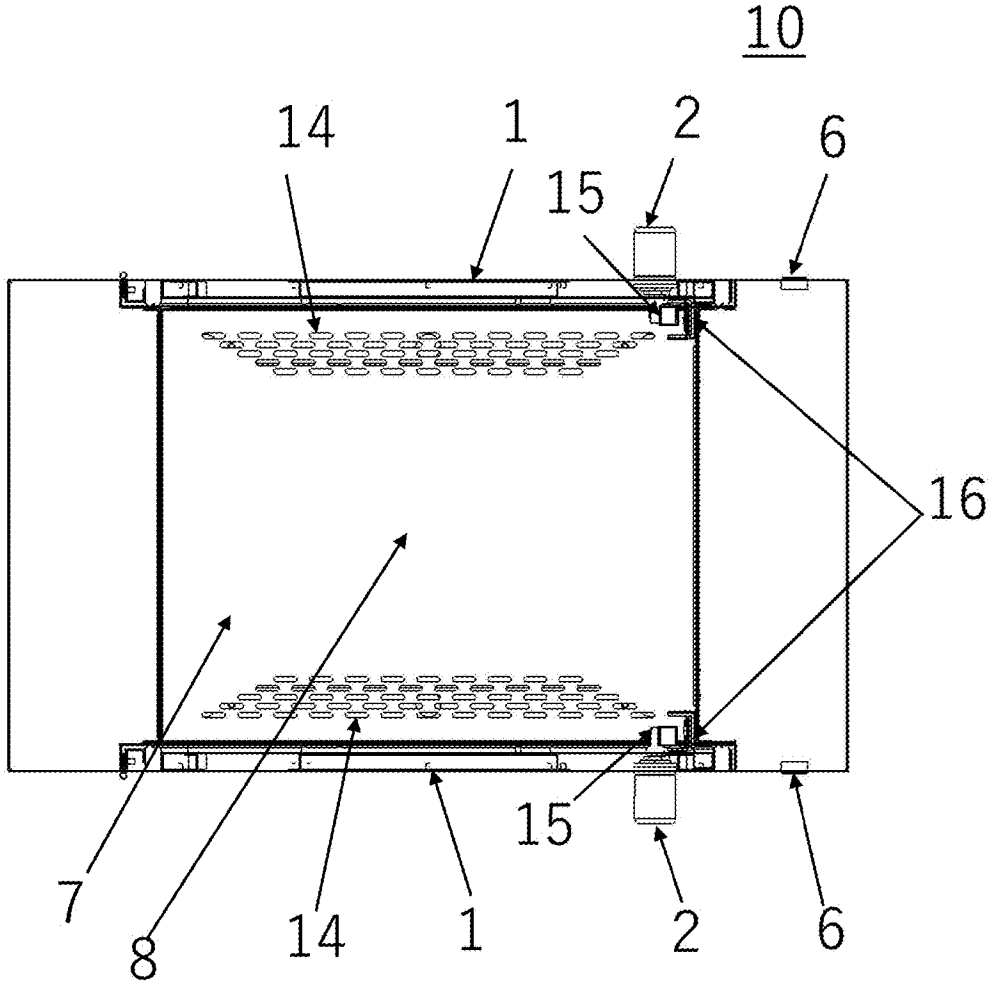
FIG. 4 is a plan sectional view illustrating an example of the pass box of Example 1.

FIG. 3 is a diagram illustrating a state where one of the doors of the pass box of Example 1 is open and illustrates the structure of the delivery space 8 and the storage stand 7 at a time when the door 1 is open. The storage stand 7 is provided in the lower portion of the pass box 10 and constitutes the delivery space 8. In this example, a storage stand slit 14 is open on the door 1 side of the storage stand 7. The storage stand slit 14 includes a slit group including a plurality of slits in the vicinity of the door 1*b* of the clean area 12 on the clean room side and a slit group including a plurality of slits in the vicinity of the door 1*a* on the contaminated area 11 side.

When the handle 2 is locked, the handle 2 is rotated by 90°, and then an intra-handle bracket 15 as a handle receiving portion is engaged with a handle receiving seat 16 and the door 1 is locked. The handle 2 and the intra-handle bracket 15 are an integrated structure, and the intra-handle bracket 15 rotates together when the handle 2 is rotated. Although dust is generated as a result of the contact between the intra-handle bracket 15 and the handle receiving seat 16 at this time, the generated dust is exhausted to the circulation path without staying in the delivery space 8 by the storage stand slit 14 being arranged at parts close to the two door sides. In addition, even when the door 1 is open, the air outside the pass box does not flow into the delivery space 8 in the pass box and mutual pollution inside and outside the pass box can be prevented.

Although the intra-handle bracket 15 and the handle receiving seat 16 are provided in the pass box 10 with respect to the handles of the two doors 1 of the contaminated area 11 and the clean area 12 in the configuration illustrated in FIG. 3, the contaminated area 11 can be provided outside as in the related art. In this case, a mechanism lengthening the interlock time of closing the two doors or preventing dust infiltration from the contaminated area into the pass box 10 may be provided. Examples of the mechanism include a cover.

It should be noted that the storage stand slit 14 is provided in the vicinity of the door 1 in the storage stand 7. The plurality of storage stand slits 14 are provided in the vicinity of the door 1 that is the peripheral portion of the storage stand 7. For example, in the storage stand 7, the storage stand slit 14 is provided at the position of ¼ or less of the distance between the two doors 1 from one of the doors 1 toward the other door 1 on a straight line interconnecting the two doors 1. In addition, the storage stand slits 14 may be large in number near the door 1 and the number may decrease toward the middle portion of the storage stand 7. As a result, the generated dust can be efficiently suctioned from the storage stand slit 14.

FIG. 4 is a plan sectional view of the pass box 10 of Example 1. In FIG. 4, the two doors 1 are closed and the intra-handle bracket 15 is locked to the handle receiving seat 16.

In Example 1, the intra-handle bracket 15 and the handle receiving seat 16 come into contact with each other in the pass box 10 on the clean room side (clean area 12 side) of the pass box 10, and thus it is possible to prevent clean room-side contamination attributable to dust generation.

In addition, as for the dust generation attributable to the contact between the intra-handle bracket 15 and the handle receiving seat 16, the air pushed in by the blower 3 passes through the HEPA filter 4, becomes the clean air, and passes through the delivery space 8 in the pass box 10. The clean air passes through the storage stand slit 14 open near the door on the storage stand 7, returns to the blower 3 again, and circulates in the same path. In this manner, it is possible to prevent contamination in the pass box 10 and on the clean room side by means of the airflow circulation path allowing continuous clean air supply to the delivery space 8.

Example 2

Figure 5:
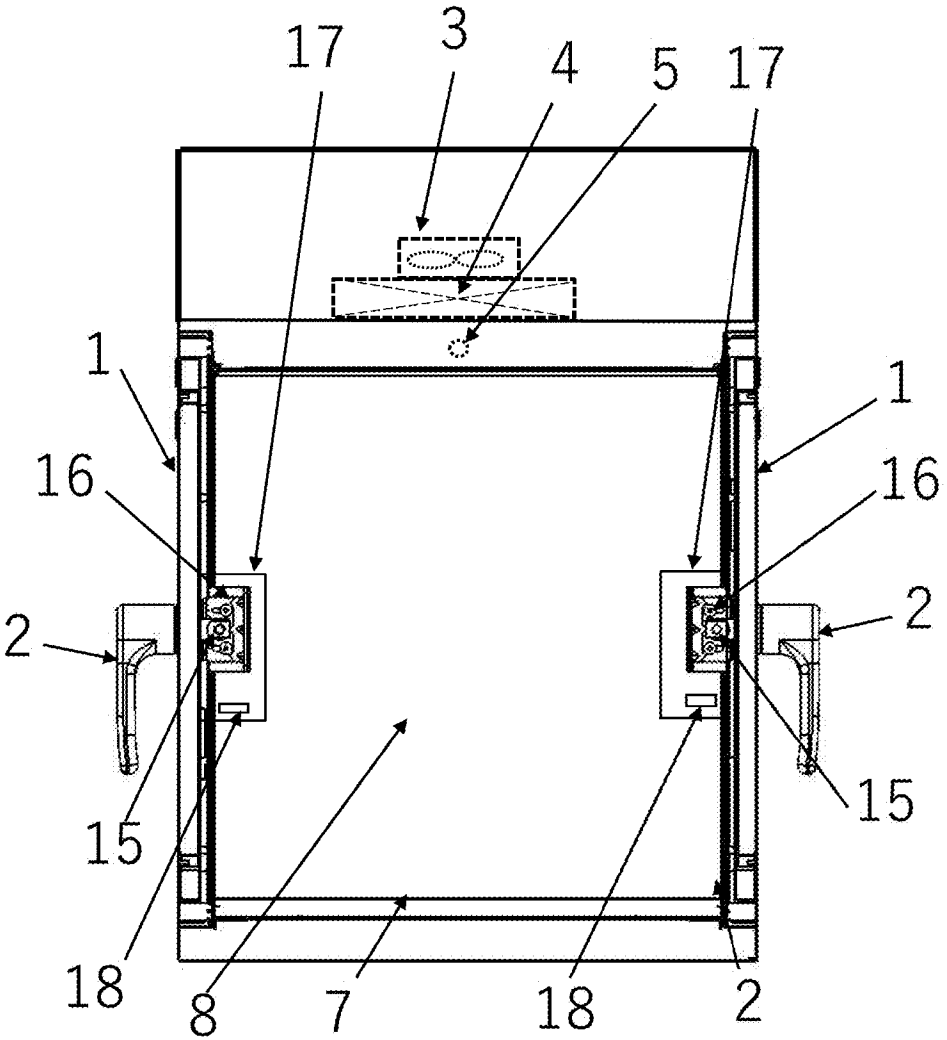
FIG. 5 is a side sectional view illustrating an example of a pass box of Example 2.
Figure 6:
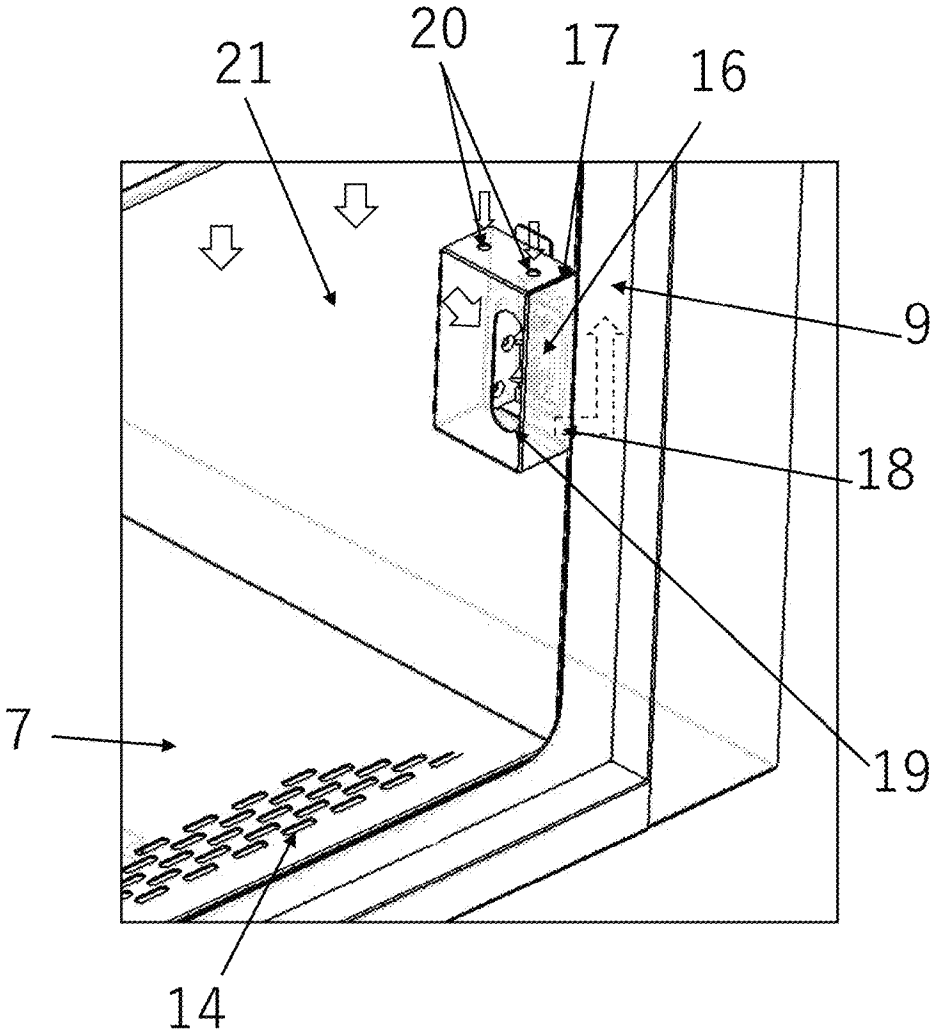
FIG. 6 is an example illustrating the structure of a handle receiving seat cover of the pass box of Example 2.

FIG. 5 is a side sectional view of the pass box 10 of Example 2. FIG. 6 is an example illustrating the structure of the handle receiving seat cover of Example 2 and illustrates the internal structure in a state where the door 1 is absent.

A handle receiving seat cover 17 is provided to cover the intra-handle bracket 15 and the handle receiving seat 16. A cover escape hole 19 is provided in the side surface of the handle receiving seat cover 17 in order to allow the movable region of the intra-handle bracket 15 to escape. A cover air supply hole 20 is provided in the upper portion of the handle receiving seat cover 17. A lining exhaust slit 18 is open in a side lining 21 of the pass box 10. The air that passes through the lining exhaust slit 18 returns to the blower 3 side by a circulation path 9 configured between the side lining 21 and the side surface of the door 1.

Although dust is generated by the intra-handle bracket 15 and the handle receiving seat 16 coming into contact with each other when the handle 2 is locked and the door 1 is closed, the clean air that has passed through the HEPA filter 4 is supplied from the cover escape hole 19 and suctioned into the lining exhaust slit 18, and thus the generated dust is not scattered to the delivery space 8. The generated dust is drawn into the circulation path 9 by the suctioning of the blower 3, passes through the HEPA filter 4, and becomes clean air.

At this time, it is possible to suppress staying in the handle receiving seat cover 17 with the cover air supply hole 20 and exhaust the generated dust to the circulation path 9 in the shortest time and at the shortest distance. In addition, coarse dust can be collected by means of a pre-filter when the pre-filter is attached to the lining exhaust slit 18, and then clogging of the HEPA filter 4 can be suppressed.

As described above, according to each example, it is possible to provide a pass box that is capable of preventing contamination attributable to dust resulting from rubbing between a door handle and a handle receiver fixing the door handle when a door of the pass box is opened and closed in a case where an article is delivered in the pass box and does not contaminate dust generation to a clean room on a clean area side outside the pass box.

What is claimed is:

1. A pass box configured for delivering an article with respect to a clean room, the pass box comprising:

a blower provided in an upper portion of the pass box;

a first door on the clean room side;

a first handle provided on the clean room side and configured for opening and closing the first door;

a first handle receiving portion configured for rotating with the first handle in the pass box;

a first handle receiving seat configured for engaging with the first handle receiving portion in the pass box;

a storage stand provided in a lower portion of the pass box and having a slit configured for allowing air from the blower to be discharged from an inner portion of the pass box; and a handle receiving seat cover configured for covering the first handle receiving portion and the first handle receiving seat, wherein the handle receiving seat cover has a cover escape hole configured for allowing an operating mechanism of the first handle receiving portion to escape and an exhaust slit configured for allowing air suctioned from the cover escape hole to be exhausted.

2. The pass box according to claim 1, wherein the handle receiving seat cover has an intake hole configured for taking in air from the blower in an upper portion of the handle receiving seat cover.

3. The pass box according to claim 2, further comprising a lining configured for forming an air circulation path with an inner surface of a side surface of the pass box and the exhaust slit of the handle receiving seat cover.

4. The pass box according to claim 3, further comprising a pre-filter provided in the exhaust slit.

* * * * *